US005738271A

United States Patent [19]

Hatano et al.

[11] Patent Number: 5,738,271

[45] Date of Patent: Apr. 14, 1998

[54] FILE FOLDER HAVING A CLIP DEVICE DISPOSED THERETO

[76] Inventors: Nobuaki Hatano, 9 Pinewood Cir., Wellesely, Mass. 02181; Hsieh Feng-Chuan, 11F-2, No. 378, Sec. 1, Weh Hsin Rd., Taichung, Taiwan

[21] Appl. No.: 751,989

[22] Filed: Nov. 19, 1996

[51] Int. Cl.[6] ..... B65D 27/28

[52] U.S. Cl. ..... 229/67.4; 24/462; 206/425

[58] Field of Search ..... 229/67.4; 383/69; 24/462; 206/425

[56] References Cited

U.S. PATENT DOCUMENTS

| | | | |
|---|---|---|---|
| 3,958,693 | 5/1976 | Greene | 383/69 |
| 4,979,668 | 12/1990 | Allen et al. | 383/69 |
| 5,285,952 | 2/1994 | Ho | 229/67.4 |
| 5,354,132 | 10/1994 | Young et al. | 383/69 |

*Primary Examiner*—Stephen P. Garbe

*Attorney, Agent, or Firm*—Charles E. Baxley, Esq.

[57] ABSTRACT

A file folder includes a first sheet, a second sheet and a clip device to which one side of each of the first sheet and the second sheet is respectively fixedly connected to an upper surface thereof, the clip device including a longitudinal plate and a slidable member wherein the longitudinal plate has a first side to which the second sheet is connected and a second side to which the first sheet is connected, a first flange extending from the upper surface of the first side and an end wall extending from each one of two ends of a bottom surface of the longitudinal plate, each of the end walls having a horizontal plate extending transversely from a top edge thereof and a first stop connected between the horizontal plate and the longitudinal plate, the slidable member including a middle portion from which an first portion and a second portion respectively and transversely extend such that the longitudinal plate is snugly received between the upper portion and the second portion wherein the second portion having two protrusions slidably received between the corresponding pair of horizontal plate and the longitudinal plate.

3 Claims, 5 Drawing Sheets

FILE FOLDER HAVING A CLIP DEVICE DISPOSED THERETO

BACKGROUND OF THE INVENTION

1. Field of the Invention

The present invention relates to a file folder and more particularly, to a file folder having a clip device slidably disposed thereto.

2. Brief Description of the Prior Art

FIG. 1 shows a file folder 10 which is folded along a folded side 33 of a plastic sheet so as to form two parts 31, 32 such that papers (not shown) are inserted between the two parts 31, 32 of the folder 10. A rivet 40 is disposed through one end of the folded side 33 of the two parts 31, 32 so as to pivotally connect one end of a clip device 41 to the file folder 10. The clip device 41 is made of flexible material and includes two integral clipping sides 410, 411 to form a flat C-shaped configuration for securely clipping the folded side 33 of the file folder 10 therebetween. When operating the clip device 41, a user (not shown) has to pull the other end of the clip device 41 corresponding to an axis of the rivet 40 to let the two clipping sides 410, 411 of the clip device 41 be removed from the folded side 33 of the file folder 10 so as to insert papers (not shown) between the two parts 31, 32. After that, a user (not shown) pivots the clip device 41 to clip the folded side 33 between the two clipping sides 410, 411 again to securely clip the papers in the file folder 10. However, such a conventional clip device has the following shortcomings:

(1) The clip device 41 is pivotally connected to the file folder by the rivet 40, this means an additional process has to be taken when manufacturing the file folder 30 together with the clip device 41.

(2) The end of the clip device 41 where the rivet 40 is disposed tends to be deformed when pulling the clip device upwardly, generally about 80 degrees corresponding to the folded side 33. Therefore, the clip device 41 is apt to lose its function.

The present invention intends to provide an improved file folder which has a clip device disposed thereto which is easily to be operated so as to mitigate and/or obviate the above-mentioned problems.

SUMMARY OF THE INVENTION

The present invention provides a file folder which includes a first sheet, a second sheet and a clip device to which the first sheet and the second sheet are respectively connected. The clip device comprises a longitudinal plate and a slidable member wherein the longitudinal plate has an upper surface, a bottom surface, a first side and a second side. A first flange extends perpendicularly from the first side of the upper surface of the longitudinal plate and an end wall extends perpendicularly from each one of two ends of the bottom surface. Each of the end walls has a first end, a second end and a free side from which a horizontal plate extends transversely. Each of the horizontal plates has a first stop extending from one end thereof and being connected to the first side of the longitudinal plate.

The first sheet has one side thereof fixedly connected along the second side of the upper surface of the longitudinal plate and the second sheet has one side thereof fixedly connected along the first side of the upper surface of the longitudinal plate.

The slidable member is a C-shaped member and includes a middle portion from which an first portion and a second portion respectively extend transversely from two longitudinal sides thereof. The first portion has a hook portion formed to a free side thereof and the second portion has two protrusions respectively extending longitudinally from both ends of the free side thereof such that the longitudinal plate is slidably received between the first portion and the second portion with the two protrusions respectively inserted between the corresponding pair of horizontal plate and the bottom surface of the longitudinal plate.

It is an object of the present invention to provide a file folder with a clip device disposed thereto which is slidably operated on the file folder.

It is another object of the present invention to provide a file folder with a clip device disposed thereto which is operated without being removed from the file folder.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
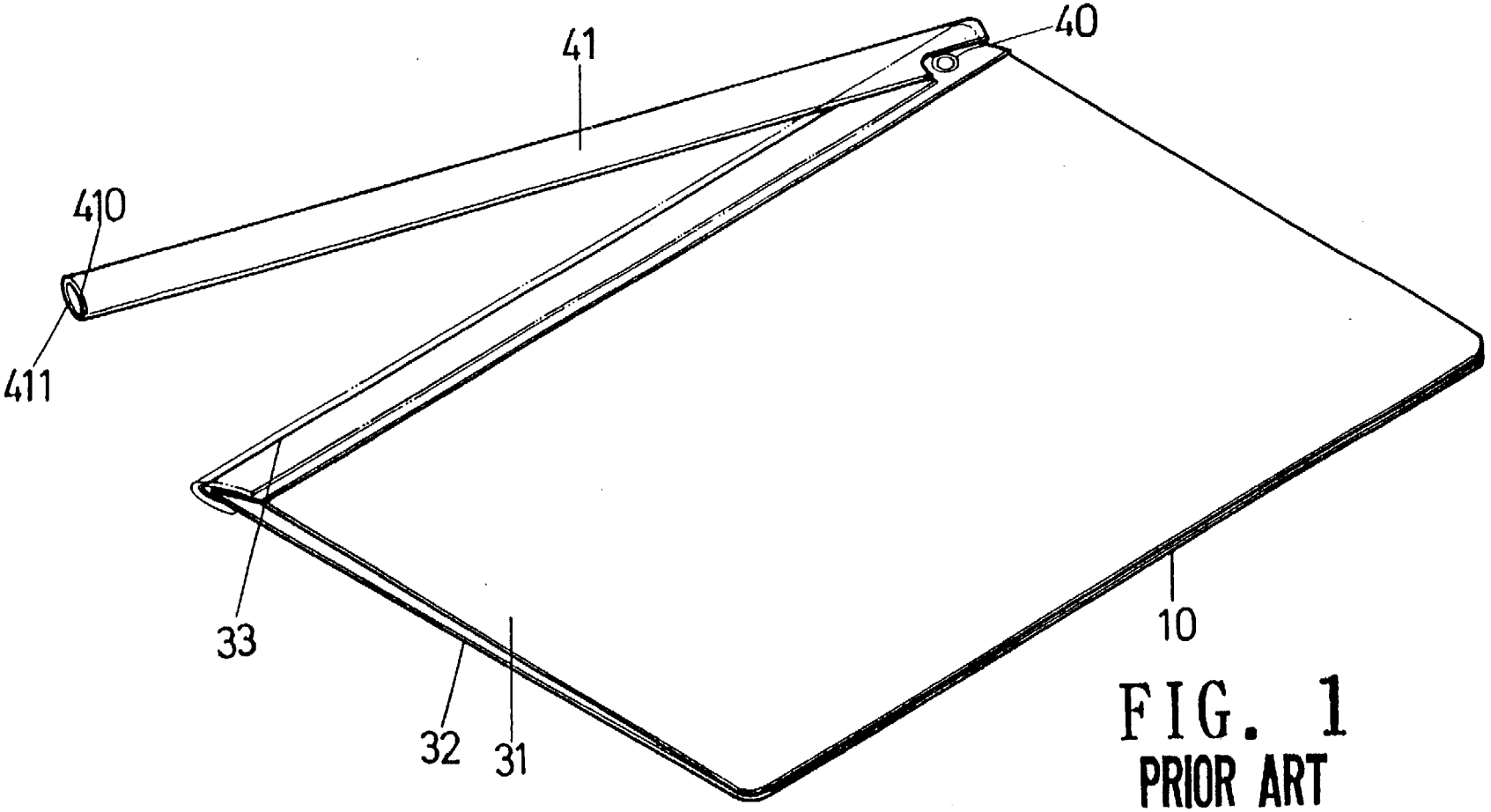
FIG. 1 PRIOR ART
FIG. 1 is a perspective view of a conventional file folder having a clip device disposed thereto.
Figure 2:
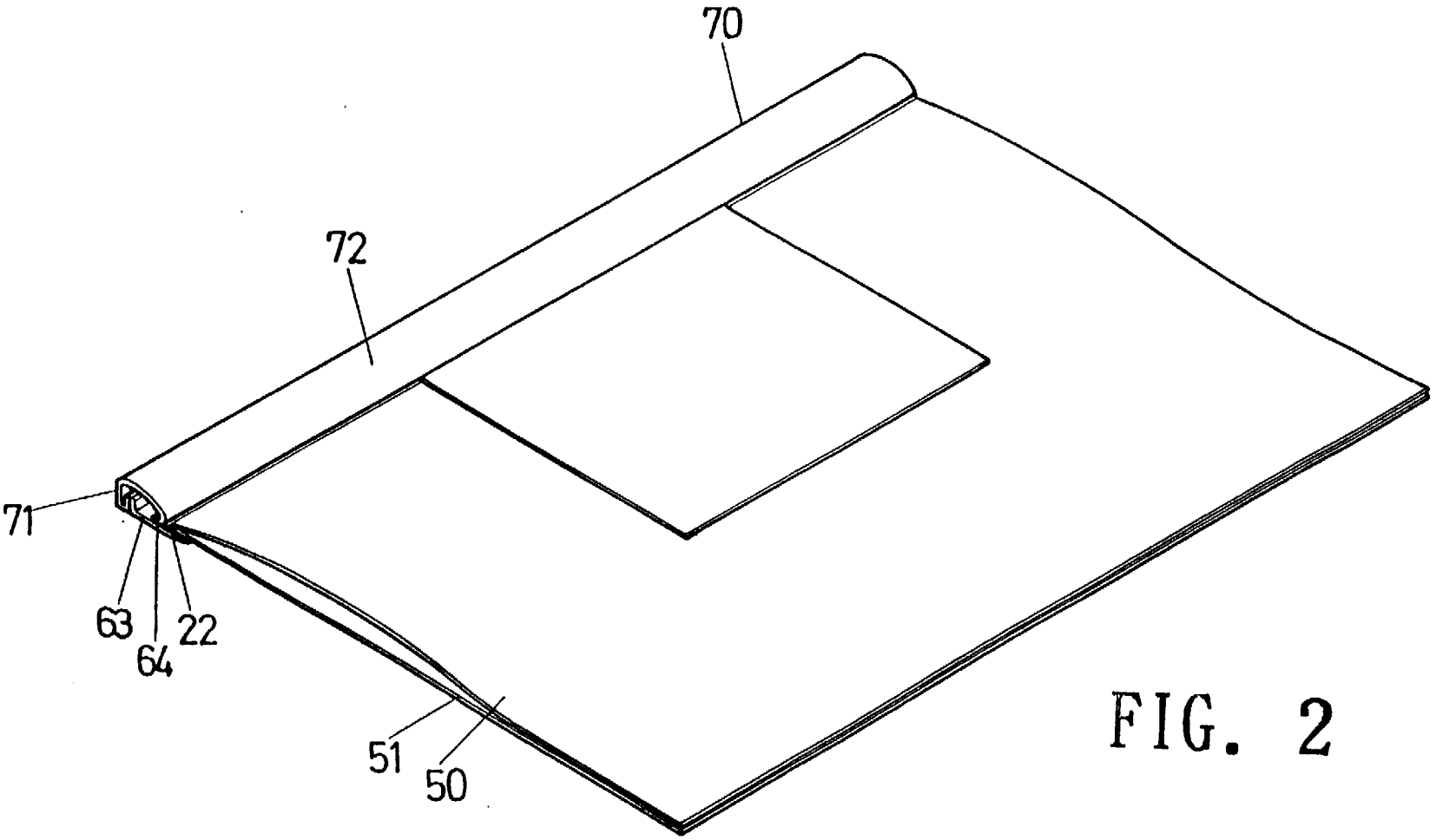
FIG. 2 is a perspective view of a file folder in accordance with the present invention which is slidably received in a slidable member.
Figure 3:
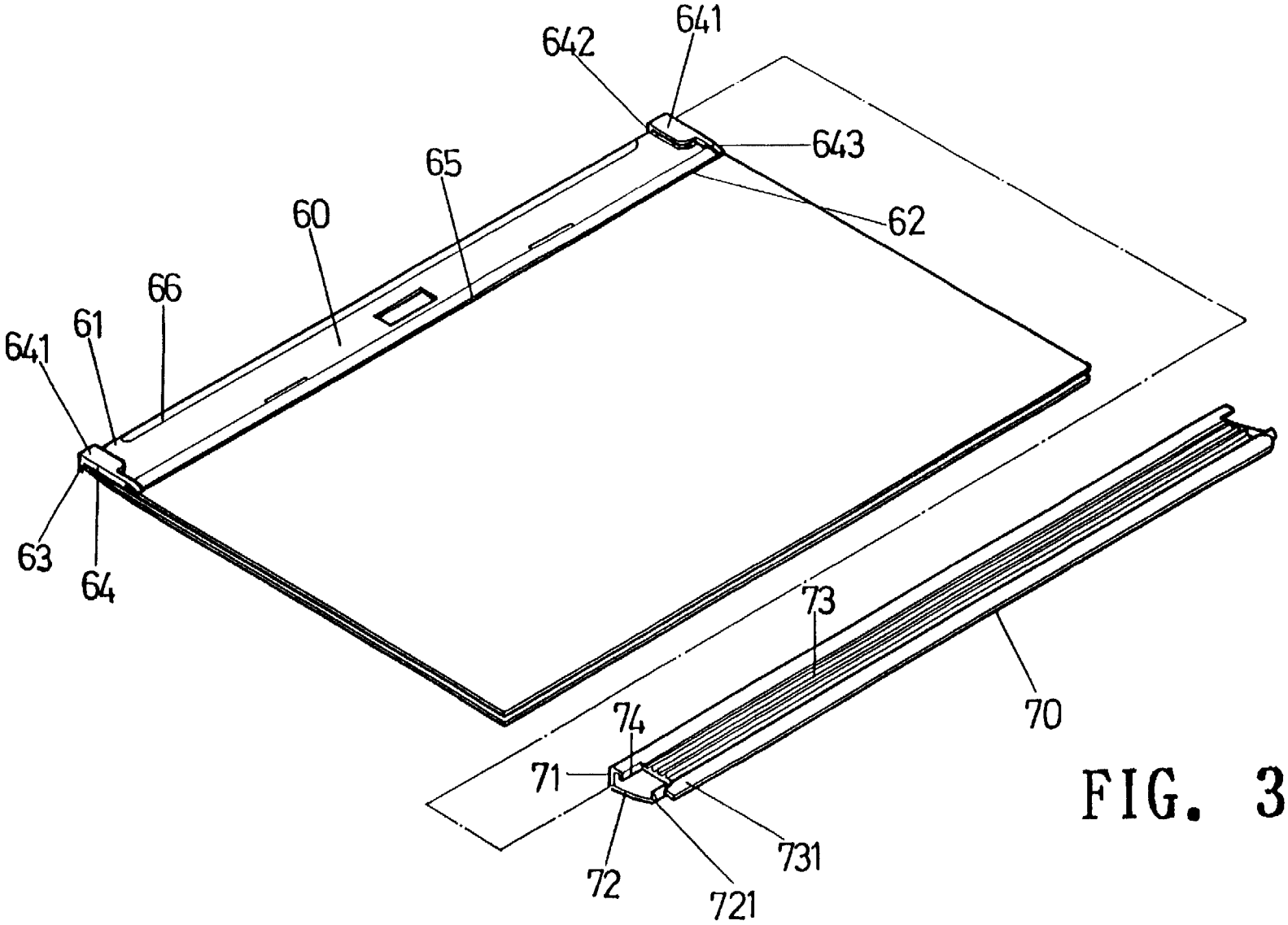
FIG. 3 is an exploded view from the bottom side of the file folder and the clip device in accordance with the present invention.

Referring to the drawings and initially to FIGS. 2 and 3, a file folder in accordance with the present invention generally includes a first sheet 50, a second sheet 51 and a clip device to which the first sheet 50 and the second sheet 51 are respectively connected so as to clip papers (not shown) between the first sheet 50 and the second sheet The clip device comprises a longitudinal plate 60 and a slidable member 70, the longitudinal plate 60 having an upper surface, a bottom surface, a first side 61 and a second side 62. The longitudinal plate 60 has a first flange 63 extending perpendicularly from the first side 61 of the upper surface thereof and an end wall 64 extending perpendicularly from each one of two ends of the bottom surface thereof. Each of the end walls 64 has a first end, a second end and a free side, a horizontal plate 641 extending transversely from the free side of each of the end walls 64. A first stop 642 is connected between the first end of each pair of the horizontal plate 641 and the first side 61 of the longitudinal plate 60 so as to define an opened portion 643 between the horizontal plate 641, the longitudinal plate 60, the end wall 64 and the first stop 642. A second stop 65 extends from the bottom surface along the second side 62 of the longitudinal plate 60 and is connected between the second ends of the two end walls 64. The longitudinal plate 60 has a third stop 66 extending from the bottom surface of the first side 61 thereof.

The first sheet 50 has one side thereof fixedly connected along the second side 62 of the upper surface of the longitudinal plate 60 and the second sheet 51 has one side thereof fixedly connected along the first side 61 of the upper surface of the longitudinal plate 60 such that papers (not shown) can be inserted between the first sheet 50 and the second sheet 51.

The slidable member 70 is a C-shaped member and includes a middle portion 71, an first portion 72 and a second portion 73 wherein the first portion 72 and the second portion 73 respectively extend transversely from two longitudinal sides of the middle portion 71 so as to define the C-shaped configuration. The first portion 72 has a hook portion 721 formed to a free side thereof and the second portion 71 has two protrusions 731 respectively extending longitudinally from both ends of a free side thereof. A contacting flange 74 extends from the second portion 73 near the middle portion 71 and toward the first portion 72.

When assembling the file folder, the longitudinal plate 60 is slidably received between the first portion 72 and the second portion 73 with the two protrusions 731 respectively and slidably inserted into the corresponding opened portion 643.

Figure 4:
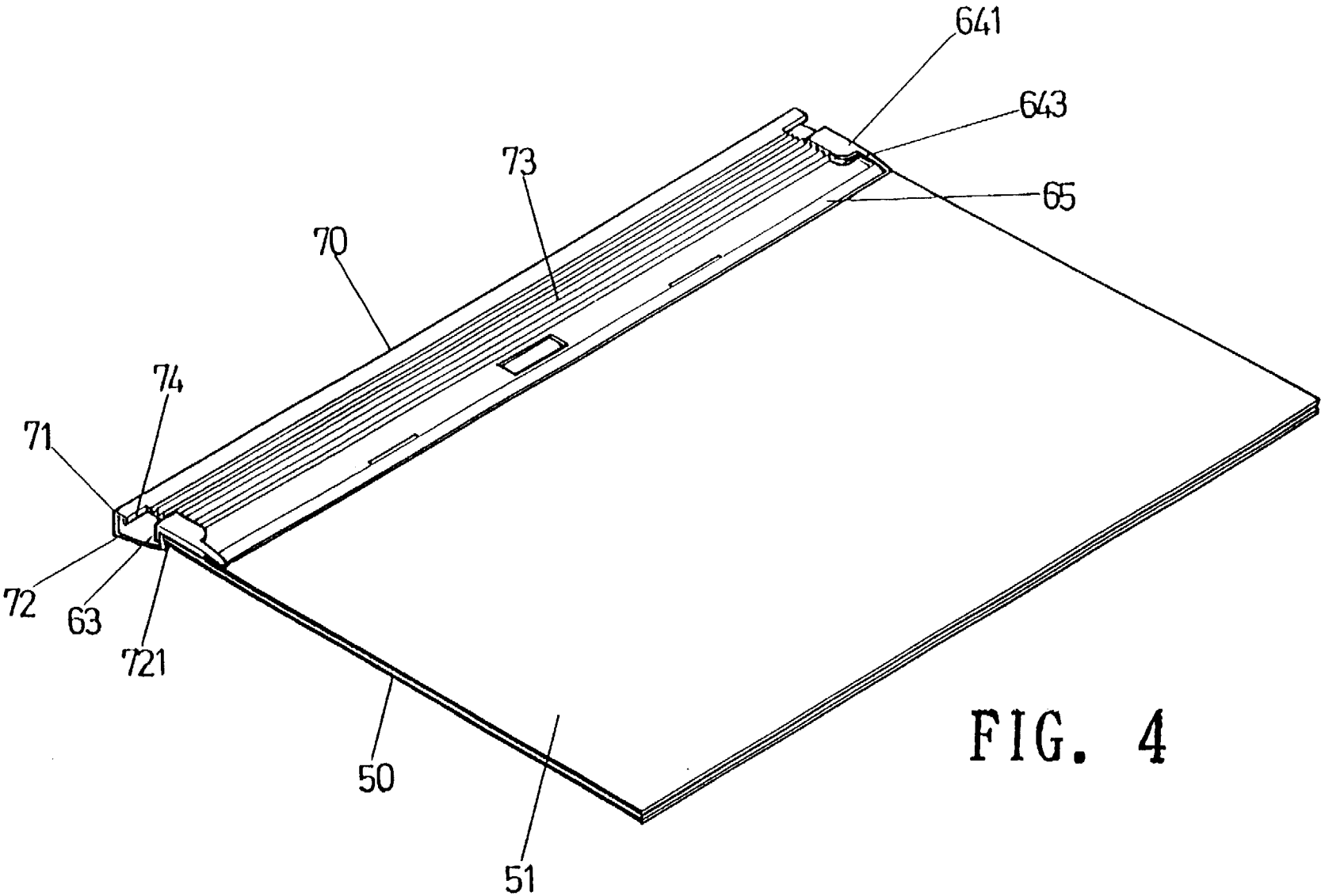
FIG. 4 is a perspective view of from the bottom side of the file folder with the clip device disposed thereto wherein the a slidable member of the clip device is slid away from the file folder.
Figure 5:
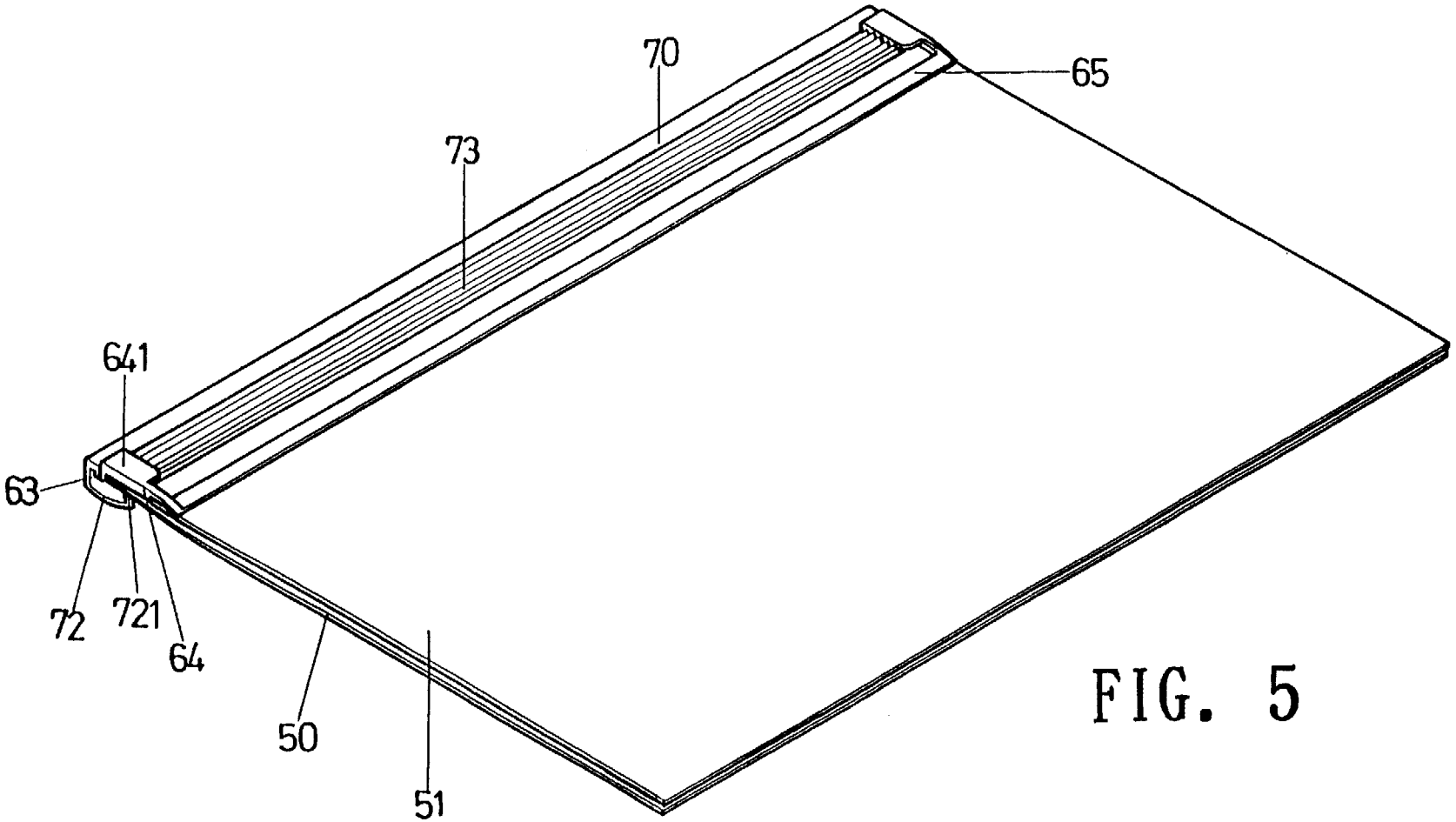
FIG. 5 is a perspective view from the bottom side of the file folder with the clip device disposed thereto wherein the slidable member of the clip device is snugly receive one side of the file folder.

Referring to FIG. 4, when the slidable member 70 is pulled away from the longitudinal plate 60, the pulling movement of the slidable member 70 is stopped by the two protrusions 731 contacting the first ends 642 and the hook portion 721 contacting the first flange 63 such that papers (not shown) can be inserted between the first sheet 50 and the second sheet 51. Referring to FIG. 5, when pushing the slidable member 70 toward the longitudinal plate 60, the hook portion 721 slidably presses the first sheet 50 tilt the slidable member 70 is stopped by the contacting flange 74 contacting the first flange 63. Therefore, a portion of the file of papers (not shown) located between the first side 66 and the second side 62 of the longitudinal plate 60 is pressed between the first portion 72 and the second portion 73 of the slidable member 70.

Accordingly, the slidable member 70 is operated by sliding it relative to the longitudinal plate 60 and this is convenient to be operated. Furthermore, the slidable member 70 is operated without being removed from the longitudinal plate 60 and this provides an excellent convenience for users (not shown).

Although the invention has been explained in relation to its preferred embodiment, it is to be understood that many other possible modifications and variations can be made without departing from the spirit and scope of the invention as hereinafter claimed.

What is claimed is:

1. A file folder comprising a first sheet, a second sheet and a clip device to which said first sheet and said second sheet are respectively connected, said clip device comprising a longitudinal plate and a slidable member, said longitudinal plate having an upper surface, a bottom surface, a first side and a second side, said longitudinal plate having a first flange extending perpendicularly from said first side of said upper surface thereof, said longitudinal plate having an end wall extending perpendicularly from each one of two ends of said bottom surface thereof, each of said end walls having a first end, a second end and a free side, a horizontal plate extending transversely from said free side of each of said end walls, each of said horizontal plates having a first stop extending from one end thereof to connect to said first side of said longitudinal plate;

said first sheet having one side thereof fixedly connected along said second side of said upper surface of said longitudinal plate and said second sheet having one side thereof fixedly connected along said first side of said upper surface of said longitudinal plate;

said slidable member being a C-shaped member and including a middle portion, a first portion and a second portion wherein said first portion and said second portion respectively extend transversely from two longitudinal sides of said middle portion, said first portion having a hook portion formed to a free side thereof and said second portion having two protrusions respectively extending longitudinally from both ends of a free side thereof such that said longitudinal plate is slidably received between said first portion and said second portion with said two protrusions respectively inserted between said corresponding pair of horizontal plate and said bottom surface of said longitudinal plate.

2. The file folder as claimed in claim 1 wherein a second stop extends from said bottom surface along said second side of said longitudinal plate and is connected between said second ends of said two end walls.

3. The file folder as claimed in claim 1 wherein said longitudinal plate has a third stop extending from said bottom surface of said first side thereof.

* * * * *